US005311720A

United States Patent [19]

Glickman

[11] Patent Number: 5,311,720

[45] Date of Patent: May 17, 1994

[54] METHOD AND APPARATUS FOR ATTACHING PARTS OF BUILDINGS OR OTHER ARTICLES TO A SUPPORT STRUCTURE

[75] Inventor: Michael N. Glickman, London, England

[73] Assignee: Ibstock Building Products Limited, Ibstock, England

[21] Appl. No.: 803,183

[22] Filed: Dec. 5, 1991

[51] Int. Cl.[5] ..... E04B 1/38

[52] U.S. Cl. ..... 52/747; 52/715; 52/699; 52/605; 52/321

[58] Field of Search ..... 52/698, 699, 700, 715, 52/730.2, 746, 701, 703, 747, 708, 711, 300, 513, 97, 718.03, 718.05, 718.06, 320, 321, 322, 323, 324, 325, 566, 567, 301, 597, 712, 713, 714, 718.04

[56] References Cited

U.S. PATENT DOCUMENTS 973,295 10/1910 Parker ..... 52/711
3,802,140 4/1974 Hickman ..... 52/300
3,831,506 8/1974 Landheer ..... 98/41
4,703,602 11/1987 Pardo ..... 52/564

FOREIGN PATENT DOCUMENTS 1034180 11/1986 United Kingdom .
1034181 11/1986 United Kingdom .
1034182 11/1986 United Kingdom .

OTHER PUBLICATIONS

Advertisement; "TOPNOTT A Natural Clary Coping System", Nottingham Brick.

*Primary Examiner*—Carl D. Friedman
*Assistant Examiner*—Kien Nguyen
*Attorney, Agent, or Firm*—Perman & Green

[57] ABSTRACT

Building or like parts can be attached to a support structure, such as the wall of a building, by using an elongate attachment member 10 or 40. Coping or capping stones 32 or 50 may be similarly attached to the top of a wall. The attachment member has to opposed outwardly-extending resilient latch portions, 18*a*, 18*b*, 48*a*, 48*b* and, in a region away from the latch portions, an outwardly-extending anchor portion, or a pair of anchor portions.

9 Claims, 11 Drawing Sheets

METHOD AND APPARATUS FOR ATTACHING PARTS OF BUILDINGS OR OTHER ARTICLES TO A SUPPORT STRUCTURE

This invention relates to a method and apparatus for attaching parts of buildings or other articles to a support structure. For example, an important use of the invention is in attaching capping or coping stones to walls.

It is often desired, in present day building and other similar activities, to attach an article to a support structure. The article may for example be a decorative facing, or a protective facing, or a window sill, or a capping or coping stone, or a column or post.

Numerous methods have been suggested for attaching building parts to support structures. None of them are completely satisfactory. There remains a need for a simple system for attaching an article to a support structure. The invention aims to provide a durable product of good appearance, and which is easily and rapidly built by relatively unskilled personnel.

As is also well known, it is desirable to provide capping or coping stones to protect walls and in particular to prevent water permeating into a wall structure. A capping stone covers the upper surface of the wall whereas a coping stone extends beyond the wall on each side so shedding water away from the vertical wall surfaces. Numerous methods have been suggested for attaching capping and coping stones. None of them are completely satisfactory. There remains a need for a capping/coping stone system which is highly vandal-resistant, which yields a durable product of good appearance, and which is easily and rapidly built by relatively unskilled personnel.

According to one aspect of the present invention, there is provided apparatus for attaching an article to a support structure which comprises an elongate attachment member of indefinite length, which as seen in cross-section, has at its upper region, two opposed outwardly extending resilient latch portions, each such latch portion being attached to or forming part of a respective wall of a channel portion of the elongate member, the elongate member having in a region away from its latch portions an anchor portion which also extends outwardly.

In use, the latch portions are arranged to hook over suitable portions of the facing, or capping stone, or window cill or other article as the case may be and the anchor portions are secured to (or interengaged with) the support structure. The elongate attachment member may be built into a building as it is constructed. An article, e.g. a decorative facing, for use in such a system may have a recess in its lower surface with the recess entry space being narrower than the maximum width of the recess. With such an arrangement, the article can be connected to the support structure by fixing, in any suitable way, the anchor portion of the attachment member to the support structure, so that the latch portions project outwardly of the support structure, and then pushing the article onto the projecting part of the attachment member so that the latch portions are resiliently deformed and enter the recess in the article, spring outwardly and engage behind the walls of the recess on either side.

According to another aspect of the present invention, there is provided apparatus for attaching capping/coping stones to walls which comprises an elongate attachment member having at its upper region two opposed outwardly extending resilient latch portions and at or in the region of its lower end anchor portions which also extend outwardly.

In use, to attach coping or capping stones to walls, the latch portions are arranged to hook over suitable portions of the capping/coping stone and the anchor portions are located between successive courses of bricks or stones of the wall. The attachment member is built into the wall as the wall is constructed. A capping-/coping stone for use in such a system has a recess in its lower surface, the recess entry space being narrower than the maximum width of the recess. With such an arrangement, the capping/coping stone can be brought to a location vertically over the top course of bricks of the wall, from which the upper part of the attachment member projects upwardly, and then may be placed on the top course by being pushed downwardly over the latch portions, which are deformed towards each other and then resiliently spring outwardly again to engage walls of the recess. These latch portions securely hold the stone on the wall.

In this specification, the words "upper" and "lower" have been used in relation to latch portions and anchor portions of the elongate attachment member. It will be understood that these words are used without limiting effect and refer to the case when the elongate attachment member is disposed with its length horizontal, as would be the case when it is incorporated in a wall of uniform height with a horizontal foundation. The attachment member may be also used in other orientations, for example substantially vertical as seen in FIG. 10 herein or tilted, as seen in FIG. 8 herein.

In a preferred embodiment of the invention, the elongate attachment member is bifurcated into the two latch portions towards its upper region. In use mortar may be placed in the channel so provided, and pushed along horizontally to beneath the capping/coping stone just laid. When it hardens it prevents the latch portions from moving inwardly towards each other and so firmly locks the capping/coping stone in place. This procedure is repeated moving along the wall.

Also according to an aspect of the invention, there is provided a method of attaching a building part or the like to a support structure which comprises securing to or partly within the structure an elongate attachment member which has a pair of latching portions, and placing the building part (which has a recess in its underside) over the latching portions so that said portions interengage with the walls of the recess to hold the building part in place on the structure.

In a method of attachment of one or more capping-/coping stones to a wall it is preferred to successively build courses of the wall in conventional manner, and then one carries out the steps of entrapping an attachment member in the wall by building an upper course which overlays a part of the member while allowing resilient latch portions of the attachment member to project upwardly from the upper surface of the upper course, and placing a recessed capping/coping stone on the latch portions so that the latch portions engage walls of a recess in the underside of the stone so as to retain the stone in position.

In a preferred embodiment of such a method, one employs an attachment member which has an upwardly-open channel at least part of whose side walls constitute the resilient latch portions and progressively fills the channel with a material that hardens over time by forcing said material longitudinally of the wall so as to fill sections of the channel that are located beneath an already-applied capping/coping stone.

The invention will be better understood from the following non-limiting descriptions of examples thereof given with reference to the accompanying drawings in which.

Figure 1:
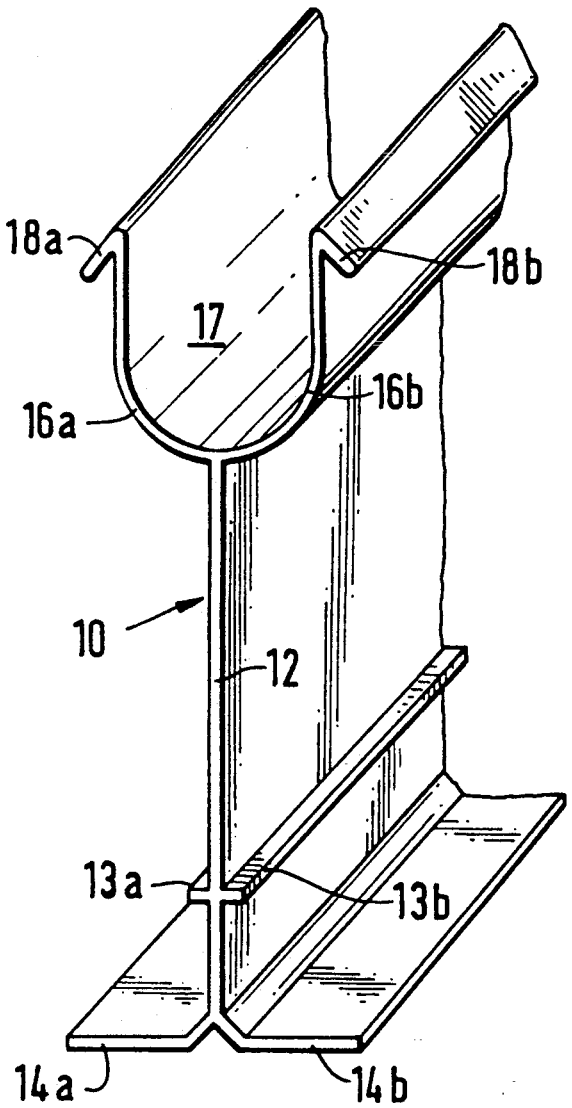
FIG. 1 is an isometric view of an elongate attachment member usable in a method according to the invention for attachment capping or coping stones to a wall.

Referring firstly to FIG. 1, one form of attachment member according to the invention is illustrated therein which may be made of metal or of synthetic plastics material. It may advantageously be a plastics extrusion of indefinite length. The attachment member comprises a web 12 which, in use of the member, is intended to be substantially vertical. Laterally of the web 12 at the lower end project anchor members (also called anchor portions herein) 14*a*, 14*b* and above these short flanges 13*a*, 13*b* also project laterally from the web.

While the elongate attachment member has been described as including a pair of anchor portions, it will be realised that equally good results in many instances can be achieved by having a single anchor portion extending laterally to one side only of the web.

The web 12 is bifurcated towards its upper end to define latch portions 16*a* and 16*b* having latching tips 18*a* and 18*b*. The material of at least the latch portions is to some extent resilient, that is to say it can be deformed from the shape shown and will spring back substantially to that shape, as will be better understood after a consideration of FIGS. 2–5.

Figure 2:
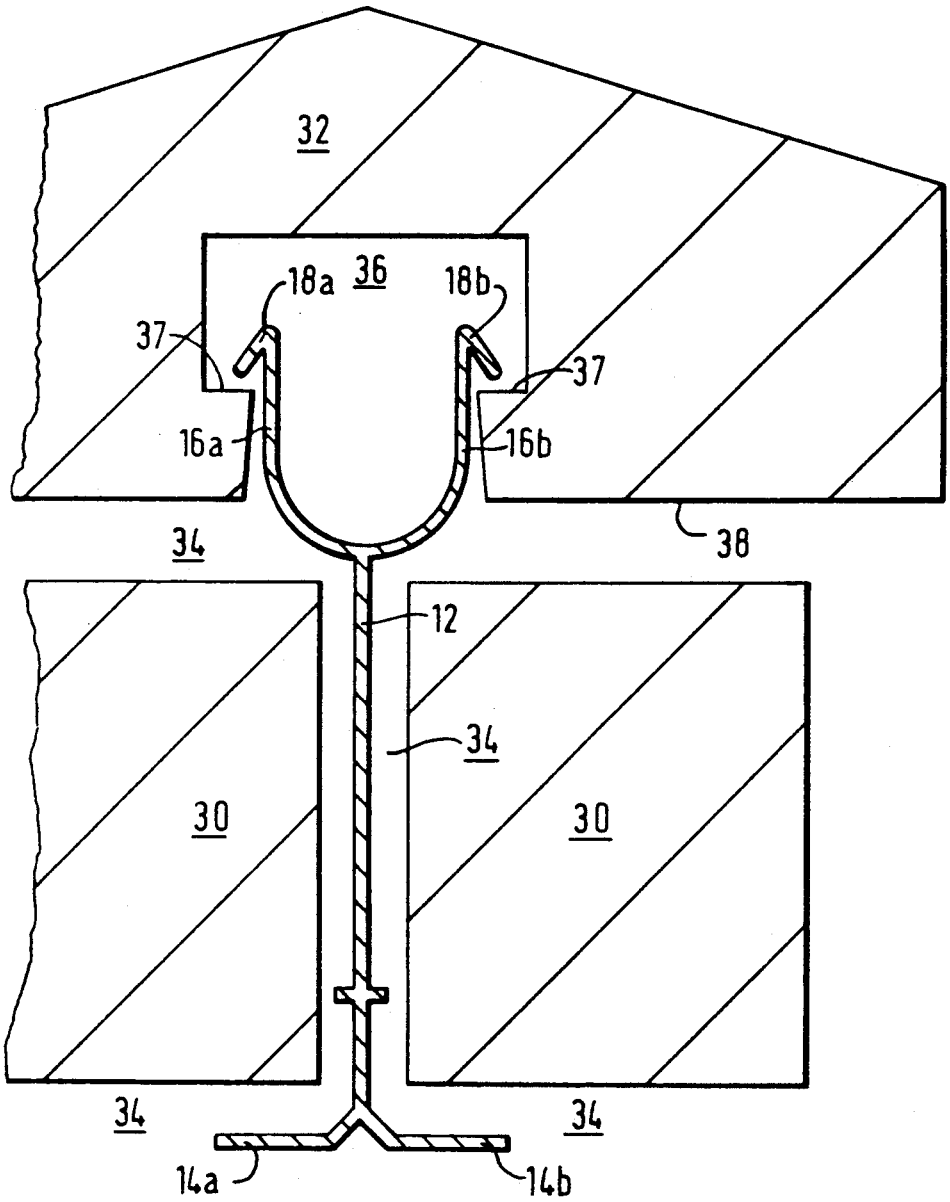
FIG. 2 is a view of the attachment member of FIG. 1 in cross-section, looking endways of the wall.

As seen from FIG. 2 in use the anchor members 14*a* and 14*b* are located between the top and next to top courses of a wall, bricks of this wall being shown at 30 and a coping stone at being shown at 32. The anchor members 14*a*, 14*b* extend laterally of the attachment member underneath the bricks 30 and these bricks are separated by the web flanges 13*a*, 13*b* which serve to provide a proper spacing between these bricks. During the building of the wall the spaces indicated at 34 will be filled with mortar in the conventional manner.

The coping stone has a central recess 36 therein, extending right through the stone from one end to the other of the coping stone. This recess is wider at the interior of the stone than it is at the latch portion entry space where it opens at the bottom surface 38 of the coping stone. As seen in FIG. 2, the coping stone 32 has been pushed downwardly over the latch portions 16*a* and 16*b* deforming them inwardly and they have sprung back to the position illustrated in FIG. 2. In the sprung back position the latch tips 18*a* and 18*b* overlie the respective surfaces 37 of the recess and so prevent the coping stone 32 from being removed from the wall in all normal circumstances.

Figure 3:
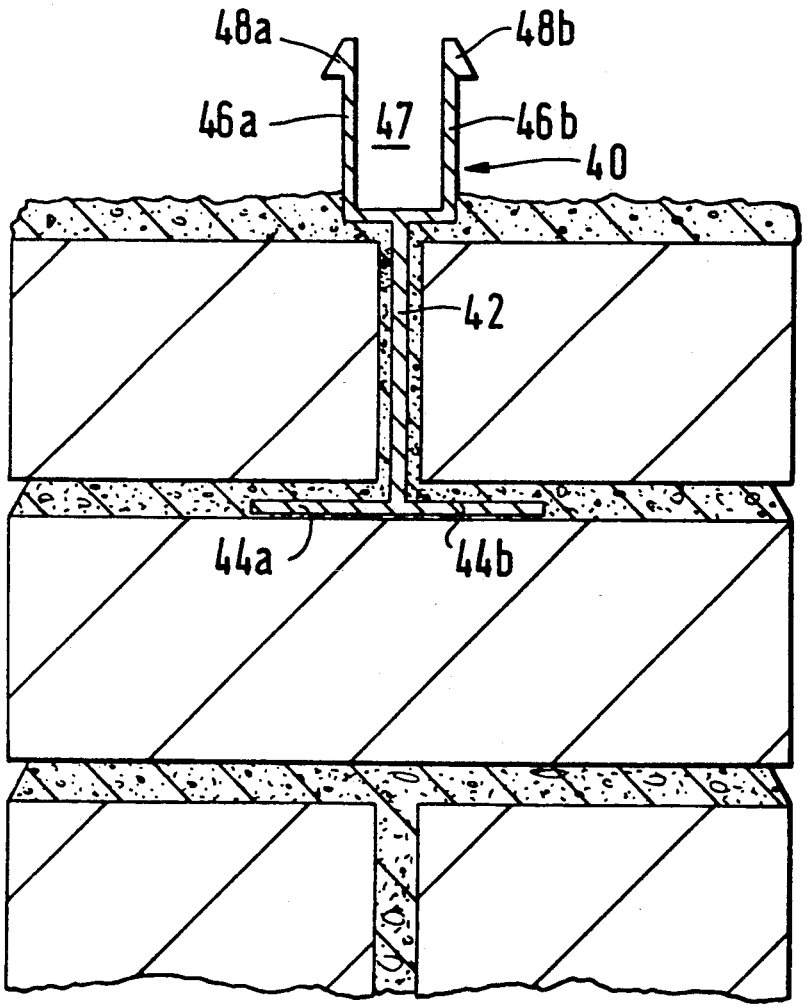
FIG. 3 is a transverse cross-section through a wall showing an alternative embodiment of attachment member kept in position by the two bricks of an upper course of the wall and by the mortar therearound.
Figure 4:
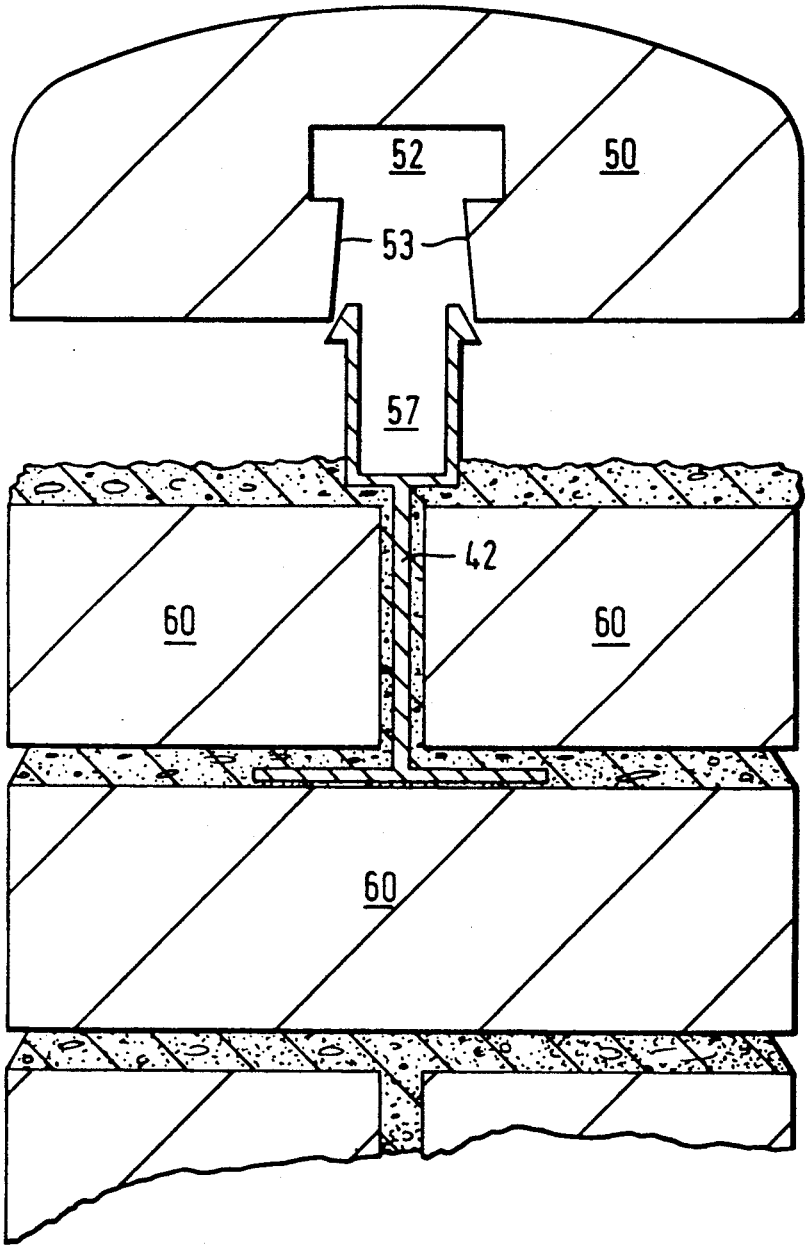
FIG. 4 is a view similar to FIG. 3 but showing a capping stone of particular design being placed on the wall.
Figure 5:
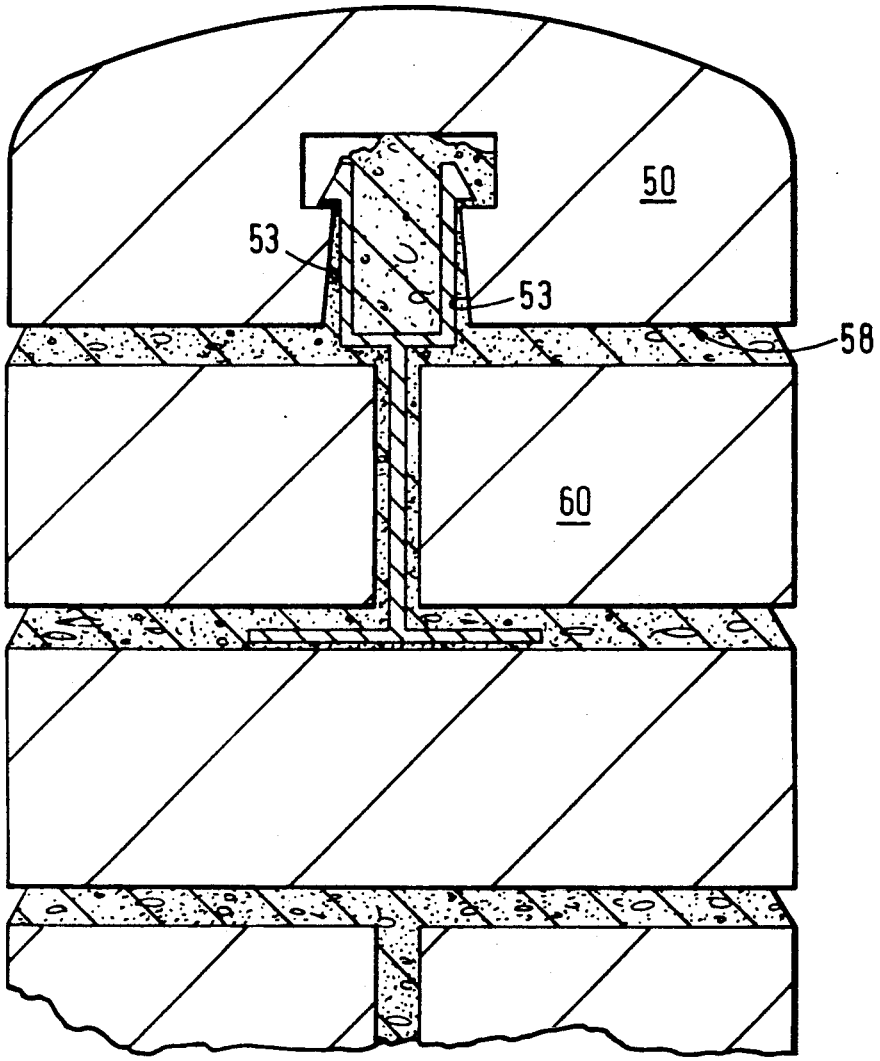
FIG. 5 is a view similar to FIG. 4 but showing the capping stone in position and locked therein by the portions of the attachment member

As will be seen, the latch portions 16*a* and 16*b* define a channel 17 which, in the use of the attachment member 12, is part-filled with mortar. Attachment members of about 50 to 300 mm in length and coping stones which have a length of for example about 2 feet of half a meter may be employed. Of course attachment members of greater or lesser length may be used if desired but the states range is preferred as a good compromise between ease of manufacture by conventional methods and economy of effort in the building of a wall. The attachment members are arranged lengthwise in series as the wall is built. Attaching members of greater length, e.g. about ½ or ¾ meter, may be useful for a long straight wall. In the building of a wall, the attachment member will be bedded within the top course of bricks of the wall as is indicated in FIGS. 3–5, and then the capping or coping stones are placed thereon in turn. Each time a stone is placed on, with the latching portions located in its recess, mortar placed into the channel 17 is pushed along with a suitable tool so as to pack the recess within the stone that has just been laid. The setting of this mortar then produces a substantially rigid body within the channel 17 and so effectively precludes the latching portions 16*a*, 16*b* from being shifted inwardly, so locking the stone on the wall in a secure, durable and substantially vandal-proof manner. As will be appreciated, the procedures involved, which merely amount to suitably bedding the attachment member in the wall and then placing an appropriately designed capping or coping stone over the latching portions in the manner described are simply executed even by unskilled personnel. The resulting wall can be expected to remain vandal-proof for a considerable time, in contrast to some capping/coping stone systems at present commercially available.

Referring now to FIGS. 3–5, the attachment member 40 differs from that shown in FIGS. 1 and 2 in that the shape of the latch portions is more rectangular than curved, so leading to a substantially rectangular channel 47 instead of the U-shaped channel 17, and the flanges 13*a*, 13*b* of the member 10 have been dispensed with. The parts of the attachment member 40 are in principle similar to those of the attachment member 10 and bear reference numerals which are increased by 30 compared to FIGS. 1 and 2.

The capping stone 50 employed in this embodiment of the invention has a recess 52 which opens to the bottom surface 58 of the coping stone 50. The shape of the top surface of the stone may of course be chosen as desired. The stone 50 is shaped so as to provide tapering lead-in surfaces 53, FIGS. 4 and 5. The surfaces 53 are preferably planar and each located at an angle between 2 and 10 degrees, desirably between 3 and 8, and preferably 4 to 6 degrees to the vertical. The height of the recess is preferably from about 45 to 60% of the maximum height of the stone, with a value of 48 to 55% being preferred. Assuming the width of the recess is 100 unites, it is desirable that the width of the entry portion of the recess at the surface 58 should be about 75 to 95 units, and its minimum width should be about 65 to 85 units. However, these relationships may be varied according to the particular use to which the coping or capping stone is put. As will be understood in operation, the capping stone 50 is lowered onto the wall and as it does so it forces inwardly the two latch tips 48*a*, 48*b*. They spring outwardly once they reach the enlarged recess area 52, and in that position securely attach the capping stone 50 to the wall.

Figure 6:
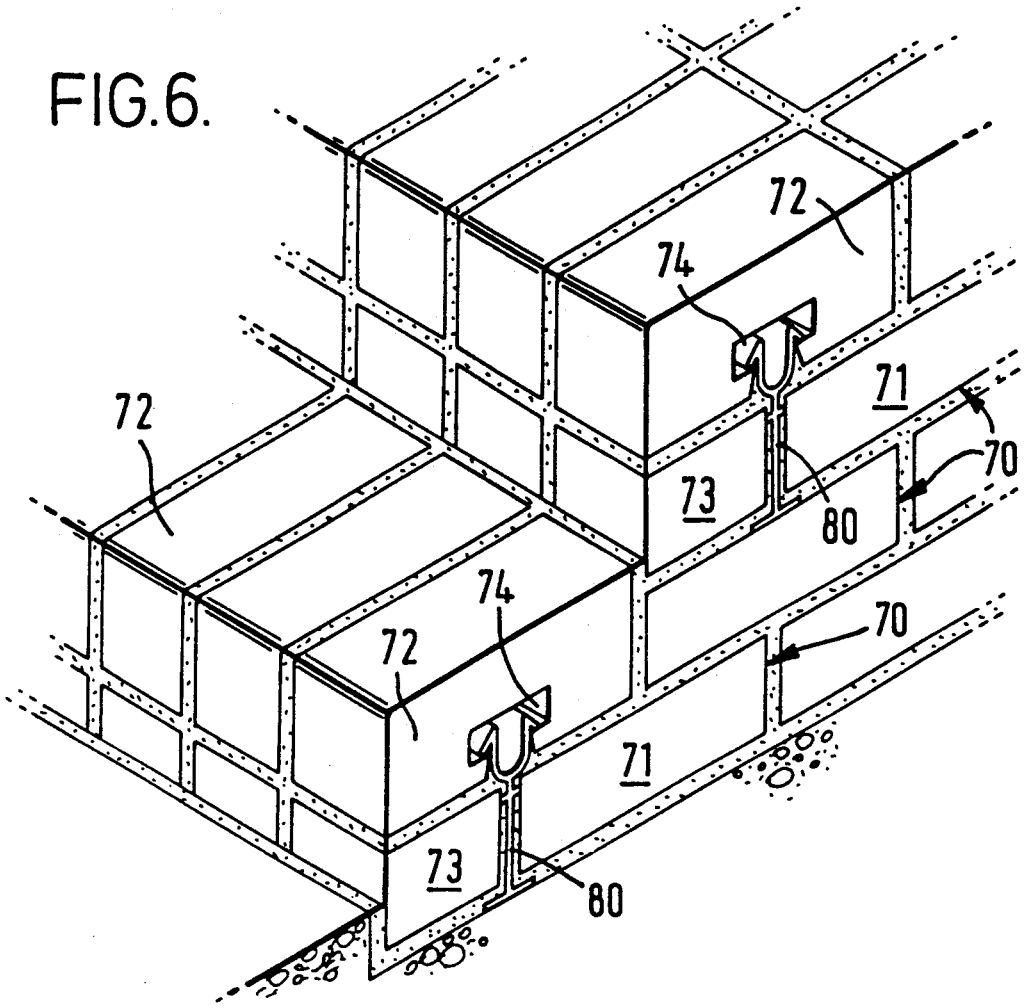
FIGS. 6 and 7 are respectively an isometric view partly in vertical cross-section and a plan view of an embodiment of the invention wherein an elongate attachment member is used to attach blocks or bricks which form steps to an undersupport.
Figure 7:
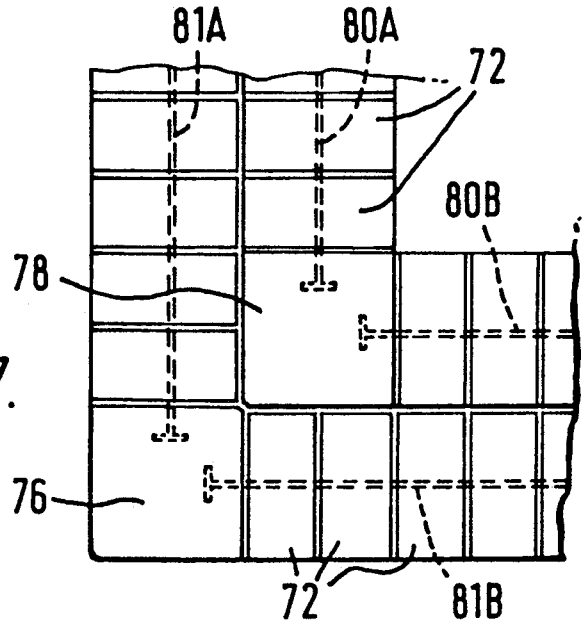

Referring now to FIG. 6, an embodiment of the invention may be employed in the construction of indoor or outdoor steps or staircases. A flight of steps, of which two steps are shown, consists of support structure 70 upon which step treads in the form of bricks 72 are placed. Each support 70 is split into two portions 71 and 73 and each brick 72 has therein a recess 74. The shape of the recess 74 may be substantially the same as the shape of the recess 52 shown in FIG. 4. An elongate attachment member 80 serves to attach the bricks 72 to the support structure 70. The attachment member 80 is preferably made in the form of a plastics extrusion and desirably has the configuration substantially as shown in FIG. 1 herein, except that the spacer flanges 13*a*, 13*b* are located further from the anchor members 14*a*, 14*b* than in the FIG. 1 embodiment. As seen in FIG. 7, corner blocks 76 and 78 are held in place due to the fact that elongate attachment members 80A and 80B extend into the block 78, and elongate attachment members 81A and 81B extend into the corner brick or block 76. In this way, these elongate attachment members serve a locking function in preventing the corner blocks 76 and 78 from becoming detached.

Figure 8:
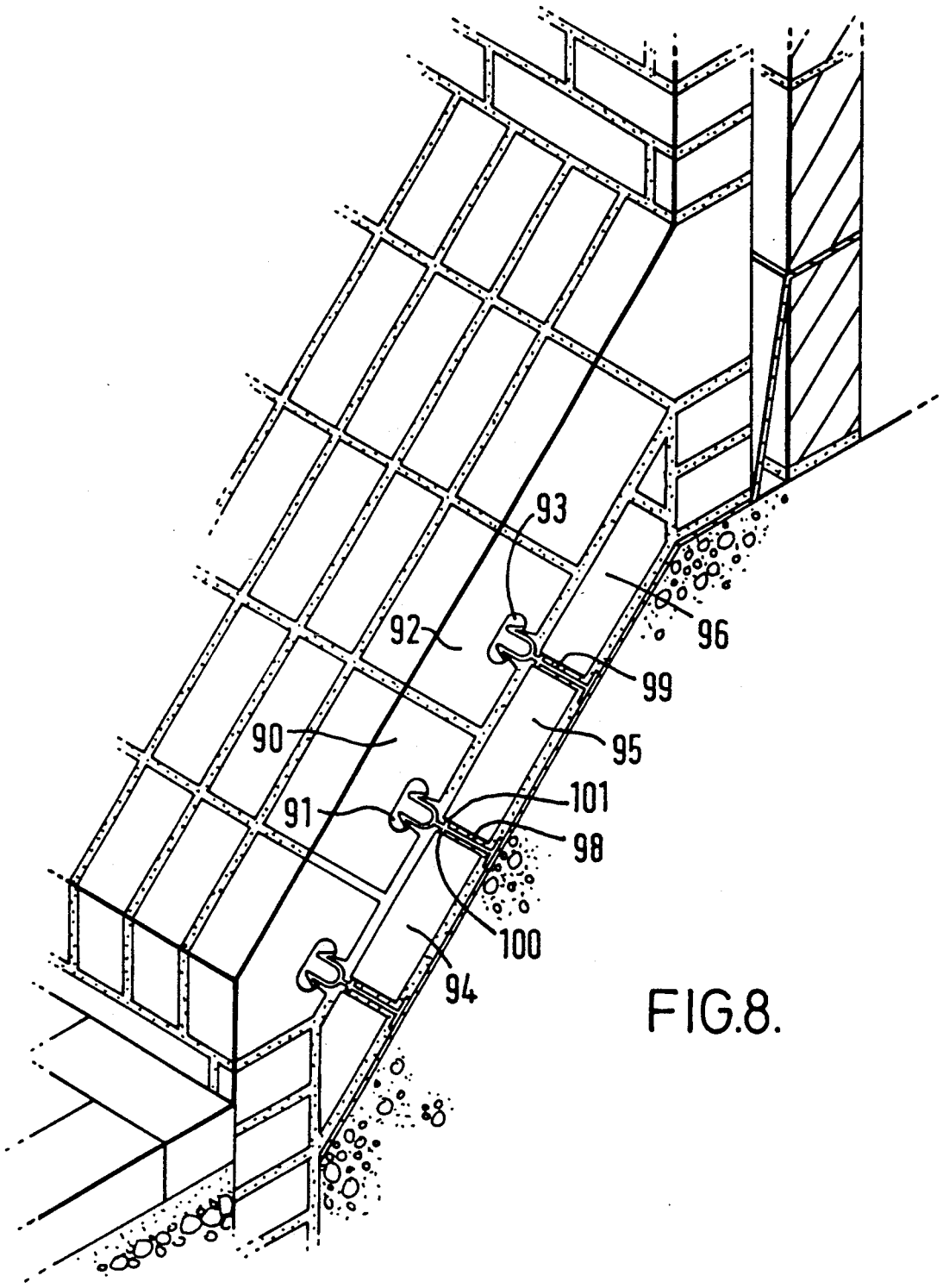
FIG. 8 is an isometric view partly in vertical cross section showing the attachment of blocks to form a plinth which can also be called sloping external building facing.
Figure 8A:
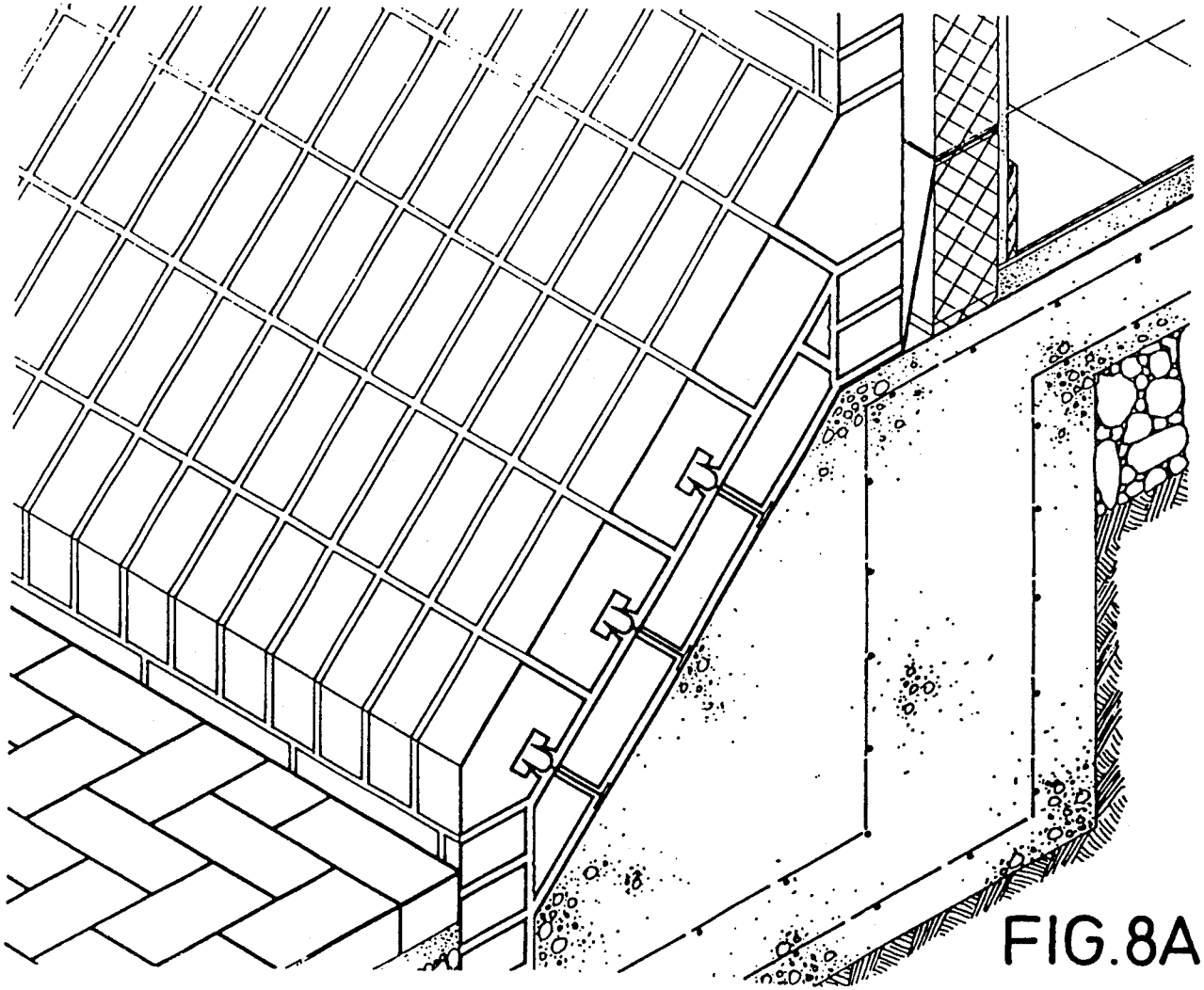
FIG. 8A is an isometric view partly in vertical cross section showing the attachment of blocks similar to FIG. 8 showing the change in slope.

Turning now to FIGS. 8 and 8A, this illustration an angled facing or plinth located on a sloping part of a wall of a building. As seen in FIG. 8, two facing hooks 90, 92 rest upon a support structure made up of connected blocks 94, 95 and 96. Each of the facing blocks has a central recess 91, 93. These recesses may have the configuration of recess 32 of FIG. 2, or recess 52 of FIG. 4. Alternatively, as illustrated, the recesses in blocks 90 and 92 may be round-ended as seen in cross-section. Each recess has sloping walls at its entry region as illustrated. Each facing block 90, 92 co-operates with a counterpart elongate attachment member 98, 99, each of these members being of a configuration generally similar to that of the member 12 of FIG. 2. However, as seen, the separation flanges 100, 101 are located closer to the channel section portion of the attachment member than in the case of the FIG. 2 embodiment.

Figure 9:
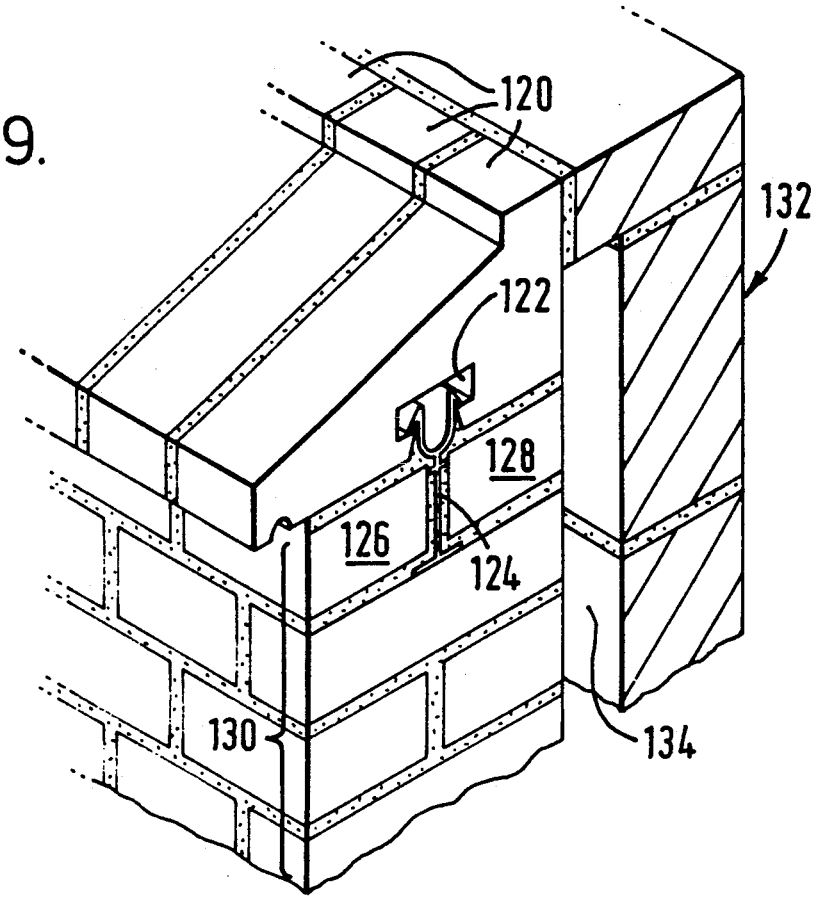
FIG. 9 is a view similar to FIG. 8 showing a window cill made up of specially shaped bricks attached to a support wall using an elongate attachment member.
Figure 9A:
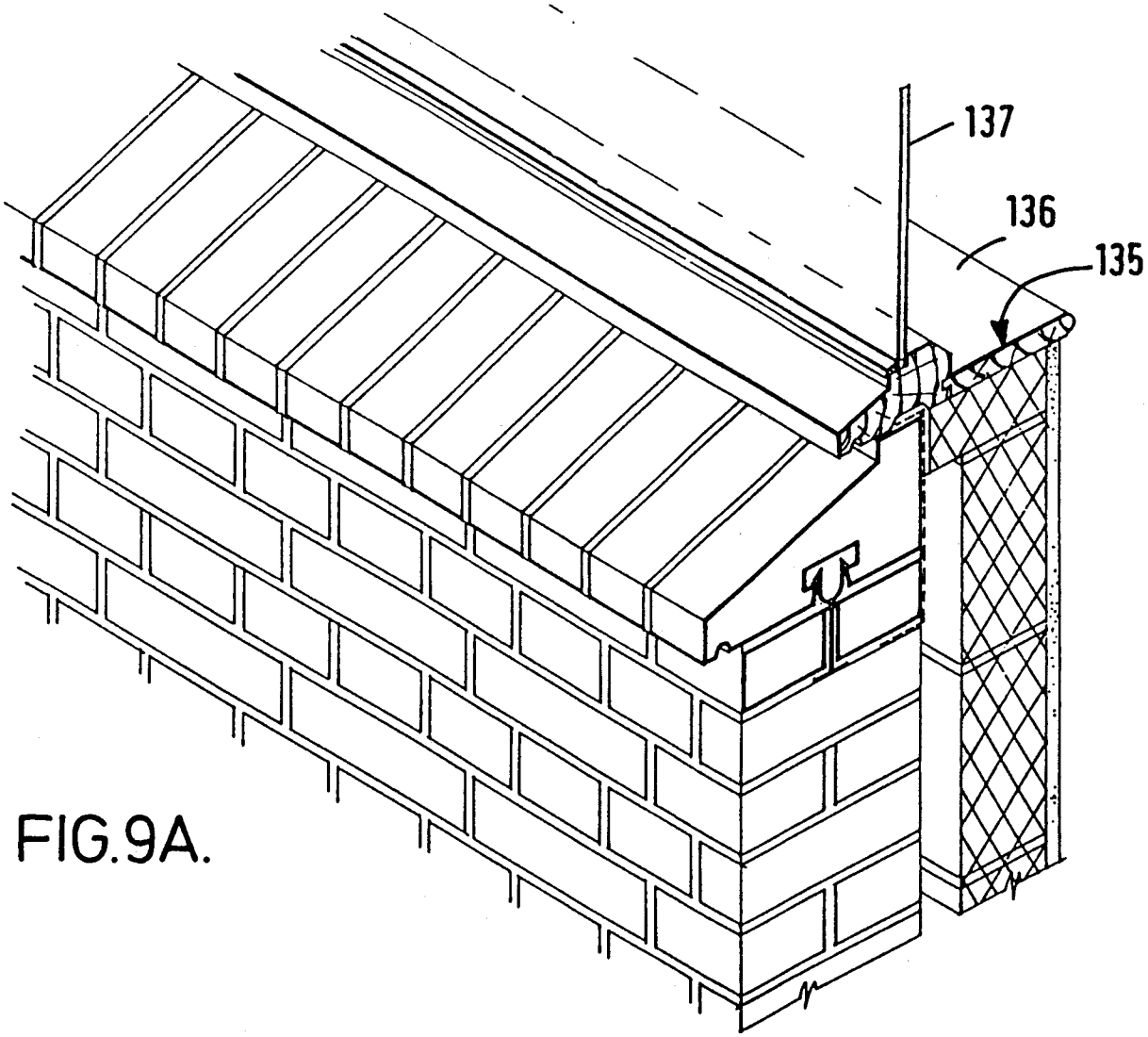
FIG. 9A is a view similar to FIG. 9 showing the window and the blocks acting as a window cill.

Referring now to FIG. 9, this illustrates a window cill made up of a number of adjacent blocks 120 of similar shape. Assembled side-by-side, these blocks together constitute a window cill. Each of these blocks has a central recess 122, this recess being of a shape generally similar to the recesses hitherto disclosed herein. These recesses all receive a single elongate attachment member 124, whose lower portion is disposed between two adjacent blocks 126, 128 which forms the upper course of a wall constituting a support structure 130. Alternatively, two or more elongate attachment members may be disposed end-to-end if needed for the width of the window. As illustrated in FIG. 9, further support structure 132 is located inwardly of a cavity 134. Of course it will be appreciated that instead of a plurality of similar shape blocks 120, one could instead have a unitary window cill, e.g. of wood or synthetic plastics material, extending across the whole of the width of the window. Such an elongate window cill would of course have a recess similar to recess 122 extending along substantially the whole of its length. In use, the support structure 30 would be build by conventional methods, with the last course being laid to incorporate the elongate attachment member 124. At that time, the channel portion of the member 124 would be extending upwardly out of the top surface of the top course 126, 128. Then, a window cill member (or a plurality of window cill blocks) would be snapped into position on the attachment member by a vertical downward movement. This will be seen as a particularly simple, easy and inexpensive method of mounting window cill on buildings. FIG. 9A shows one example with window 135 having frame 136 and window pane 137.

Figure 10:
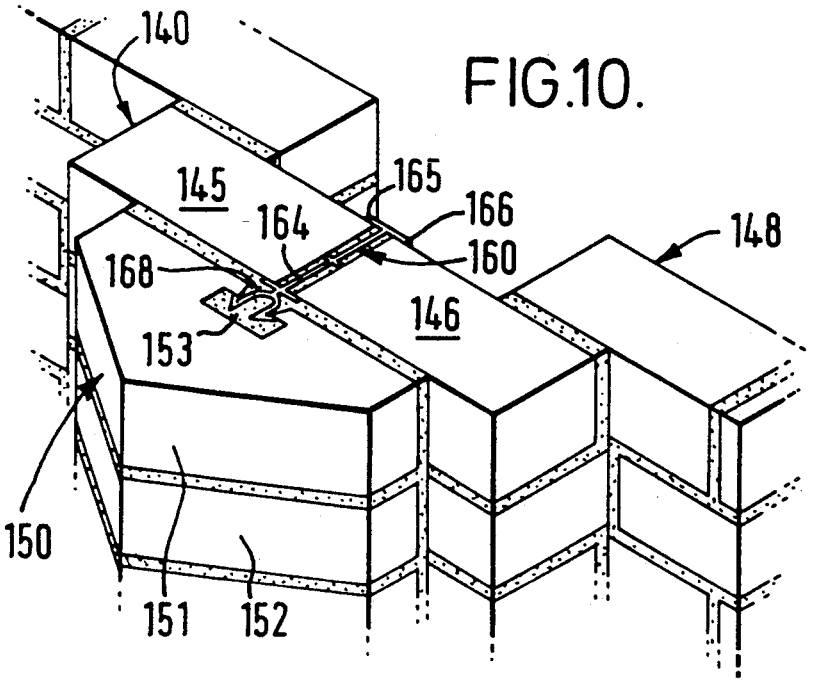
FIG. 10 is a plan partly in horizontal cross-section showing a vertical pier or column attached on the outside of a building using one or more elongate attachment members as disclosed herein.
Figure 10A:
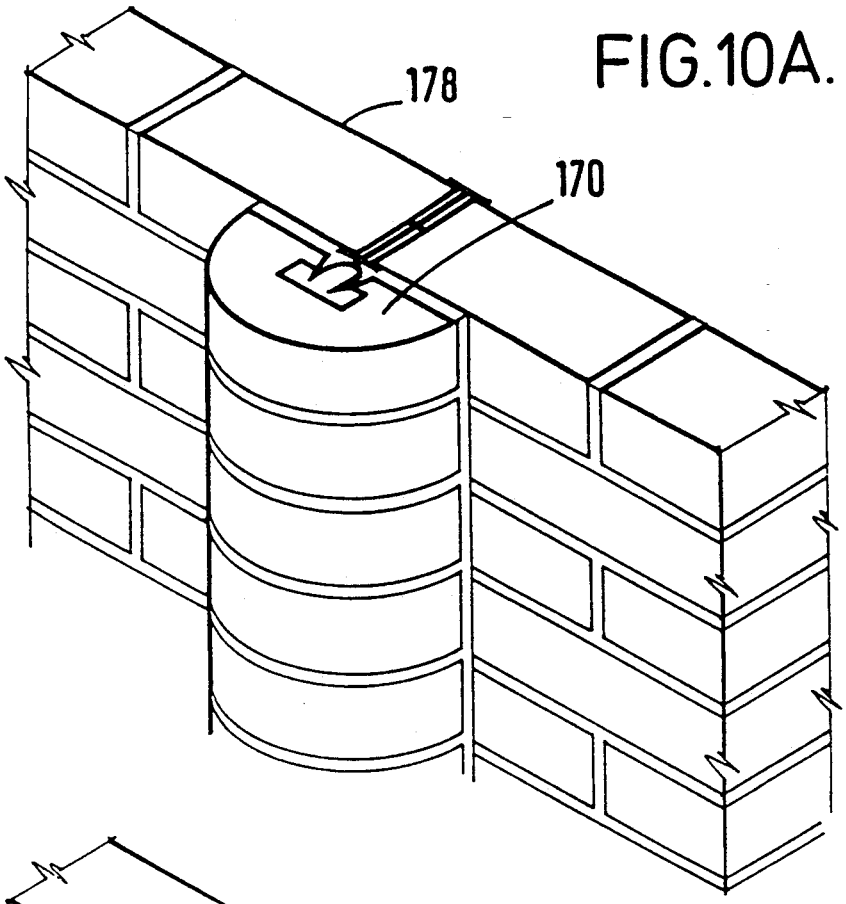
FIG. 10A is a view as in FIG. 10 showing a semi-circular pier.
Figure 10B:
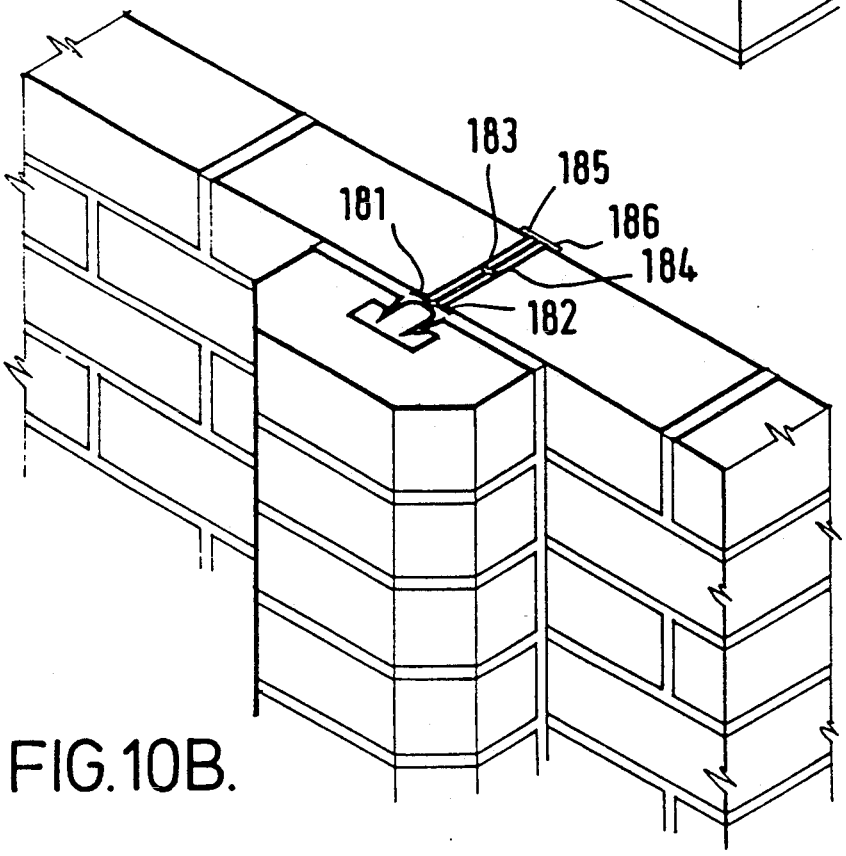
FIG. 10B is a view as in FIG. 10 showing another type of shaped pier.

Referring now to FIG. 10, this illustrates in top plan view a part of a wall buttress 140, or any projecting part of a wall, built by a conventional method, e.g. brick laying. In order to provide a visual feature on this buttress, which can be referred to as a pier and is illustrated by reference numeral 150, the pier is made up of a number of pentagonal shaped blocks 151, 152 each of which has a recess 153. Desirably this recess 153 extends the full width of each block 150. An elongate attachment member 160 is disposed to extend vertically with its web portion 164 disposed between bricks 145, 146, and its anchor portions 165, 166 located at the rear of the bricks 145 and 146. The channel portion 168 of the attachment member then projects outwardly of the surface of the vertical face of the buttress 140, and extends upwardly and downwardly in a vertical orientation. When it is desired to build the pier on the front of the buttress, the lowermost block of the pier is presented to the face of the buttress and pressed onto the lowermost portion of the attachment member by applying a force in a horizontal direction, generally perpendicular to the vertical face of the buttress, and subsequent blocks are then similarly applied to the attachment member one on top of each other until the required vertical height of pier is achieved. For added security of attachment, in this embodiment, as in the FIGS. 1-5 embodiment, mortar may be placed within the trough of the channel 168 progressively as the pier blocks 150 are placed one by one into position. This mortar, upon hardening, precludes the latch portions of the channel part of the attachment member from being deformed inwardly, and so prevents the blocks becoming detached. FIG. 10A shows an embodiment where pier 170 has a semi-circular column shape attached to wall 178. FIG. 10B shows another example showing another type of exterior shaped pier and where sections 181-186 of the elongate attachment member interact with the wall that the pier is attached to.

It will be seen that an embodiment of the invention provides an effective method and apparatus for attaching capping stones and coping stones to walls, and permits a sturdy and durable wall to be obtained using simple building procedures. In particular, the invention avoids the need to have wall bricks or capping/coping stones of specially designed form and shapes that are complicated to manufacture. The attachment member may be made of any suitable material but it is preferred that it is synthetic plastics, for example polyethylene or polyvinyl chloride.

The invention also resides in a wall including an attachment member of the kind described, and in a capping/coping stone based on the concept illustrated in FIGS. 2 and 4. Other embodiments of the invention permit the simple and efficient fitting of window cills and the construction of piers and facings, whether internal or external, on buildings.

In this specification, reference has been made to capping and coping stones. In this context the word "stone" is used in a sense to denote any building element which serves the purpose of a capping or coping stone, whether or not it is made of the material commonly called "stone". For example, the capping/coping stones usable in the invention could be made of synthetic plastics material, or be clay-based. Building parts used in the invention could be of natural or synthetic stone, metal, wood, plastics material or any other substance suitable for building.

I claim:

1. A method of attaching a masonry article to a support structure selected from a wall structure and a building structure, the method comprising securing an apparatus to or within said support structure said apparatus comprising an elongate attachment member of indefinite length, which has an upper region, a first part made up of two symmetrical opposed outwardly extending resilient latch portions, the latch portions together defining and forming a wall of a channel portion of the elongate member, the elongate member also having an elongate web which is connected to the first part and which has, at an edge remote from the said wall, anchor portions which extend laterally of the web; said method comprising placing the masonry article, provided with a recess in its underside, over the latching portions; and pressing down on the masonry article, the recess wall having a taper into the recess such that the two latch portions are compressed towards each other and the recess also having an enlarged area in an interior of the recess such that the two latch portions can expand after being compressed so that they interengage with said walls of the recess of the masonry article to hold said article on the structure.

2. A method of attaching a masonry article to a support structure comprising steps of:

providing the masonry article with a recess, the recess having latching surfaces therein;

attaching an attachment member to the support structure, the attachment member having a first end with two opposed symmetrical resilient latch portions and a channel therebetween, and a web extending away from the first end towards a second end, at least a portion of the web being used to attach the member to the support structure;

connecting the masonry article to the first end of the attachment member, the step of connecting comprising the first end being compressed into the recess and expanding with the latch portions being located behind the latching surfaces; and filling the channel with a mortar material.

3. An attachment member for attaching a series of masonry articles to a support structure, the attachment member comprising:

an elongated center web;

anchor portions located at a first end of the web, the anchor portions extending laterally outward from the web; and two latching portions located at an opposite second end of the web, the latching portions being spaced from each other the being resiliently deflectable towards each other with a receiving channel therebetween for receiving mortar, each latching portion having a laterally outwardly extending latching tip for engaging retaining surfaces in recesses of the masonry articles.

4. A building component assembly comprising:

a block of material selected from stone and brick, the block having a recess therein with an enlarged section having latch retaining surfaces located on opposite sides of the recess; and an attachment member connected to the block, the attachment member having a first end located in the recess of the block, an opposite second end forming an anchor portion; and a web between the two ends and extending out of the recess, wherein the first end of the attachment member has two generally parallel cantilever latching portions with laterally outwardly extending latch tips on each latching portion and, the latch tips contact the latch retaining surfaces in the recess of the block to retain the block with the attachment member.

5. An assembly as in claim 4 further including mortar between the two spaced latching portions.

6. An assembly as in claim 4 wherein the spaced latching portions have a general U-shape to form a channel between the latching portions.

7. An assembly as in claim 4 wherein the second end has two anchor portions that extend laterally outward from the web in opposite directions.

8. An assembly as in claim 4 wherein the recess extends into the block from a bottom surface of the block and the latch retaining surfaces are generally parallel to the bottom surface.

9. An assembly as in claim 8 wherein the latching portions are deflectable towards each other, and the first end and an entrance to the recess are suitably sized relative to each other such that the latching portions are deflected towards each other during insertion into the recess and form a snap lock connection with the block when the block and attachment member are fully connected.

* * * * *